US006015011A

United States Patent [19]

Hunter

[11] Patent Number: 6,015,011

[45] Date of Patent: Jan. 18, 2000

[54] DOWNHOLE HYDROCARBON SEPARATOR AND METHOD

[76] Inventor: Clifford Wayne Hunter, 339 County Fair, Houston, Tex. 77060

[21] Appl. No.: 08/884,756

[22] Filed: Jun. 30, 1997

[51] Int. Cl.[7] ..... E21B 43/08; E21B 43/38

[52] U.S. Cl. ..... 166/265; 166/227; 166/228; 166/369; 210/170; 210/747

[58] Field of Search ..... 166/105, 227, 166/228, 265, 369, 370

[56] References Cited

U.S. PATENT DOCUMENTS 4,241,787 12/1980 Price ..... 166/105
4,766,957 8/1988 McIntyre ..... 166/265
5,443,120 8/1995 Howell ..... 166/265
5,673,752 10/1997 Scudder et al. ..... 166/369 X

*Primary Examiner*—George Suchfield
*Attorney, Agent, or Firm*—Alan J. Atkinson

[57] ABSTRACT

An apparatus and method of separating hydrocarbons from water and other well fluids produced from a reservoir. A controlled permeability filter selectively permits the flow of gas, oil and other hydrocarbons while restricting water flow through the filter. The permeability of certain gases or liquids through the filter can be controlled by adjusting the pressure differential across the filter. In one embodiment of the invention, the pressure differential can be selected by adjusting the filter location within a fluid column within the wellbore. In other embodiments of the invention, multiple filters can be positioned in the wellbore, and the permeability of a filter can be adjusted to control the passage of hydrocarbons therethrough.

9 Claims, 2 Drawing Sheets

DOWNHOLE HYDROCARBON SEPARATOR AND METHOD

BACKGROUND OF THE INVENTION

The present invention relates to an apparatus and method for separating hydrocarbons from fluids in a well. More particularly, the present invention relates to an apparatus and method for controlling such separation by the relative permeability between the hydrocarbons and well fluids.

Hydrocarbons such as oil and gas are produced from subsurface reservoirs. The reservoirs also contain water and other well fluids located in the interstitial pore space in the reservoir formations. In many wells, the water volume substantially exceeds the relative volume of hydrocarbons. Accordingly, the hydrocarbon production rate is limited by the volume of water handled by the well fluid production equipment. As the well fluids are produced, the excess water and hydrocarbons are typically separated at the well surface, and the excess water is discharged or reinjected into subsurface formations.

When a wellbore perforates the reservoir and a perforated tubing is positioned within the wellbore, downhole reservoir pressure flows the hydrocarbons and well fluids toward the tubing interior and to the well surface. If the subsurface well pressures are sufficiently large, the hydrocarbons and well fluids are produced to the well surface. In low pressure wells, or as the subsurface well pressures decline during the producing life of a well, the reservoir pressure does not sustain hydrocarbon production to the well surface. Various techniques, such as rod pumps and electric submersible pumps, artificially lift the well fluids to the well surface.

Although surface separator equipment typically removes excess water from produced hydrocarbons, other separation techniques have been attempted to accomplish such separation downhole in the wellbore. For example, electric powered centrifugal separators have been positioned downhole to generate a fluid separating vortex within the downhole separator. However, such equipment requires power and moving components subject to wear and failure. Additionally, such equipment mechanically agitates the well fluids, thereby modifying the separation characteristics of such fluids.

Accordingly, a need exists for an improved apparatus and method for separating hydrocarbons from well fluids produced from a subsurface reservoir. The apparatus and method should economically provide such separation for otherwise marginal wells, and should be adaptable to the production of high hydrocarbon flow rates.

SUMMARY OF THE INVENTION

The present invention provides an apparatus for separating hydrocarbons from other well fluids downhole in a wellbore extending downwardly from a well surface. The apparatus comprises a body for closing the wellbore to isolate the well fluids below said body from atmospheric pressure at the well surface, a permeable filter for selectively permitting hydrocarbons below said body to pass through said filter and for selectively restricting other well fluids below said body from passing through said filter, and an aperture through said body for permitting hydrocarbons passing through said filter to move above said body.

The method of the invention is practiced by positioning a body downhole in the wellbore to close the wellbore and to isolate the well fluids below said body from atmospheric pressure at the well surface, by positioning a permeable filter proximate to said aperture through said body, and by selectively permitting hydrocarbons to pass through said filter and above said body through said aperture while restricting selected well fluids from passing through said filter.

In various embodiments of the invention, the filter can comprise a membrane, a close tolerance wire screen, a sintered material, a ceramic, or other material having the desired permeability. The permeability of the filter can be adjusted by the orientation or configuration of the filter, and multiple filters can be positioned in the wellbore to selectively permit passage of certain hydrocarbons.

DESCRIPTION OF THE PREFERRED EMBODIMENTS

The present invention provides an apparatus and method for separating hydrocarbons from other well fluids downhole in a wellbore. The invention is capable of accomplishing this functional result without moving components, is economical to construct, and is adaptable to wells having different orientations and characteristics.

Figure 1:
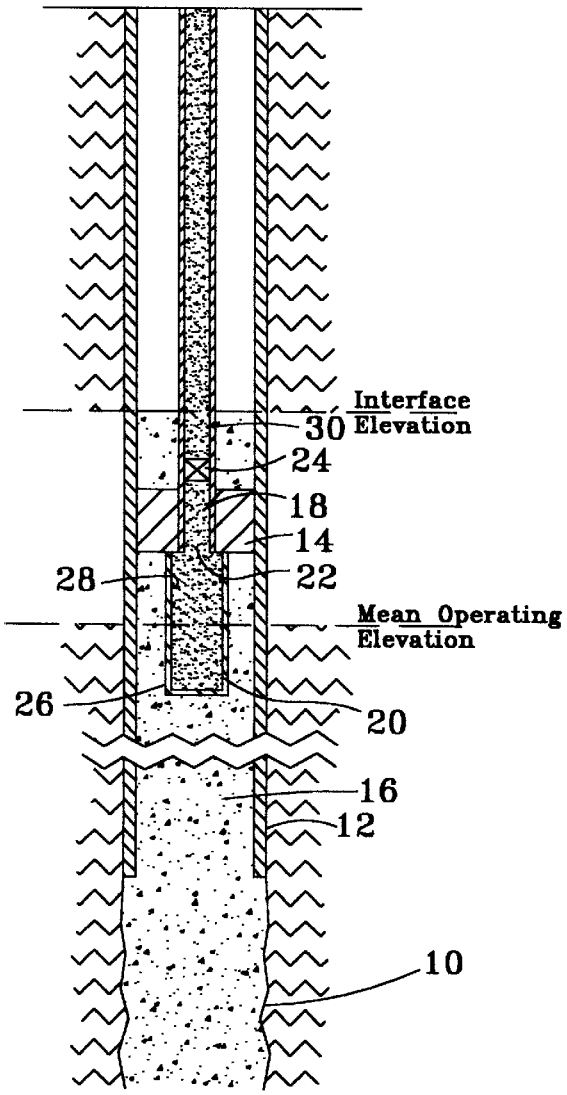
FIG. 1 illustrates an elevation view for one embodiment of the invention positioned within a wellbore.

FIG. 1 illustrates a conventional wellbore 10 having casing 12 positioned within wellbore 10. A body such as packer 14 is positioned within casing 12 with conventional setting procedures. Well fluid 16 is located within casing 12 below packer 14, and flows from at least one hydrocarbon producing geologic formation below packer 14. As previously described, well fluid 16 can comprise numerous compounds such as water, oil, gas, solids, and other liquids and fluids. The invention is applicable to conventional vertical wells and to slant hole, deviated and horizontal wells. As used herein, the phrase "above the packer" refers to the region between packer 14 and the surface of wellbore 10. The phrase "below the packer" refers to the region between packer 14 and wellbore 10 sections having a lower elevation than packer 14.

Aperture 18 extends through packer 14 to selectively permit fluid flow and tool entry through packer 14 as more thoroughly described below. Permeable filter 20 is attached to packer 14 so that filter outlet end 22 is in fluid communication with aperture 18. Filter 20 can be formed or constructed as a close tolerance wire screen filter, a membrane, a sintered material, a ceramic material, or other material or construction sufficient to accomplish the functional result provided by the invention.

When a differential pressure exists across filter 20 and filter 20 contacts well fluid 16, different compounds will migrate through filter 20 at different rates or at different differential pressures. For example, filter 20 may have a permeability sufficient to permit the migration of water at one hundred psi, while the same filter 20 may permit the migration of natural gas at five psi, and may permit the migration of oil at fifty psi. Because different compounds migrate through a filter 20 at differing differential pressures, the invention controls the relative permeability of such compounds through filter 20 to accomplish a desired result.

As shown in FIG. 1, the upper level of well fluid 16 defines an "interface elevation" in contact with atmospheric pressure. This interface elevation is typically controlled by the hydrostatic weight of well fluid 16 within wellbore 10 and the downhole reservoir pressure. In one embodiment of the invention as shown in FIG. 1, packer 14 is set one hundred feet below the interface elevation at an elevation defined as the "operating elevation". The one hundred feet elevation difference creates a hydrostatic pressure at the operating elevation based on the well fluid 16 density in the column above filter 20 and packer 14. If aperture 18 is initially closed with valve 24 when packer 14 is initially set within wellbore 10, the initial pressure of well fluid 16 at the operating elevation will be based on the hydrostatic pressure created by the one hundred foot elevation difference. As described below, the pressure at the operating elevation will vary depending on the composition of well fluid 16 and other factors.

The outside surface 26 of filter 20 contacts well fluid 16 below packer 14, and the inside surface 28 communicates with atmospheric pressure through tubing 30 which extends to the surface of wellbore 10. In this embodiment of the invention, a pressure differential exists across the thickness of filter 20, thereby controlling the relative permeability of filter 20. If the operating elevation of filter 20 is established so that a sixty psi pressure differential exists across filter 10, hydrocarbons in well fluid 16 such as oil and gas will migrate through filter 20, into tubing 30, and upwardly toward the surface of wellbore 10. If filter 20 is sufficiently impermeable at a sixty psi operating pressure to resist migration of water within well fluid 16, water will not flow into the interior of tubing 30 and will remain below packer 14. In this manner, filter 20 accomplishes the functional result of providing downhole separation of hydrocarbons from water and other compounds within well fluid 16.

Alternatively, the relative permeability of filter 20 and the differential pressure acting across filter 20 could be set at twenty psi to permit migration of natural gas or other gases such as helium and carbon dioxide through filter 20 while restricting migration of oil and other relatively heavy hydrocarbons through filter 20. Alternatively, the relative permeability of filter 20 could be selected to permit lighter end components within oil to migrate through filter 20 while restricting tars and other heavy end components from migrating through filter 20.

By separating hydrocarbons from water within well fluid 16, the quantity of fluids produced to the surface of wellbore 10 can be substantially reduced while achieving comparable hydrocarbon production rates. The excess water is retained within wellbore 10 below packer 14, and does not create disposal problems frequently associated with well fluids 16 having high water percentages. Because the water is retained within wellbore 10, the drawdown rate within the reservoir can be substantially slowed while achieving the same production rate of hydrocarbons, thereby reducing settlement and resulting subsidence of the producing formations, and reducing channeling and other production difficulties typically associated with high fluid production rates. Acordingly, the reservoir production can be effectively managed at a conservative drawdown rate without substantially reducing hydrocarbon production rates.

Figure 2:
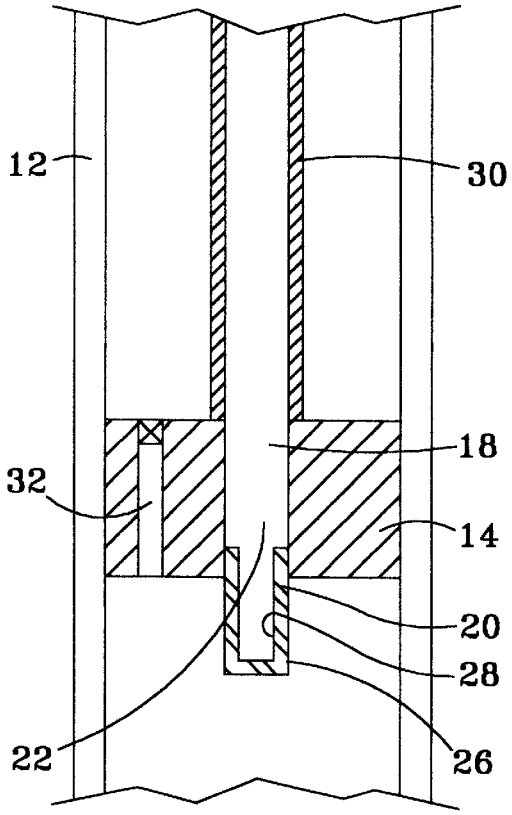
FIG. 2 illustrates a retrievable embodiment of the invention.

In one embodiment of the invention, packer 14 can comprise a resettable packer attached to filter 20 which can be withdrawn from wellbore 10 to permit access to filter 20, or to permit filter 20 to be raised or lowered within wellbore 10. This embodiment of the invention provides ready adjustment of the differential pressure acting across filter 20. In another embodiment of the invention shown in FIG. 2, aperture 18 through packer 14 can be configured to permit withdrawal of filter 20 through aperture 18 by operating tubing 30 or wireline or workover tools suitable for retrieving filter 20. Bypass port 32 through packer 14 can provide other capabilities for tool access, chemical injection, and other requirements downhole of packer 14.

Aperture 18 and tubing 30 permit chemicals or other fluids to be reverse circulated through filter 20 to clean filter outer surface 26. This feature of the invention provides a means for cleaning filter 20 downhole in wellbore 10. Alternatively, filter 20 can be cleaned downhole with other cleaning equipment, such as with conventional cleaning equipment (not shown) lowered through bypass port 32.

Figure 3:
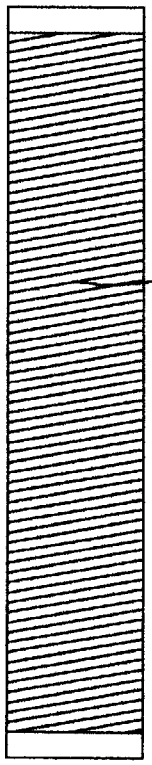
FIG. 3 illustrates one embodiment of the invention wherein the filter comprises a close tolerance wire screen.
Figure 4:
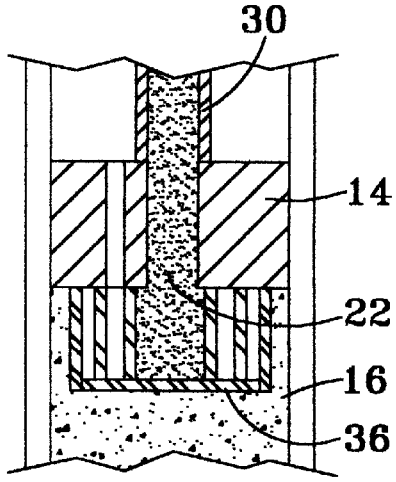
FIG. 4 illustrates another embodiment of the invention wherein the filter comprises a membrane.

As previously stated, filter 20 can be constructed or formed with any suitable construction or material which provides a selected permeability at a selected pressure differential. One embodiment of filter is shown in FIG. 3, wherein cylindrical filter 34 is formed as a close tolerance wire screen filter having a single or multiple wires wrapped around a cylindrical frame. The microscopic spaces between adjacent wire strands permits migration of gas and oil at selected pressure differentials, while restricting water migration due to the relative size and dissociation properties of water molecules. FIG. 4 illustrates a membrane form of permeable filter 36.

The configuration and internal composition of the filter can be selected to accomplish different migration characteristics and performance characteristics. In other embodiments of the invention, the filter can be selectively covered with a mechanically drawn cover to selectively modify the surface area in contact with well fluid 16, or to selectively modify the permeability of the filter itself. To accomplish this latter function, the filter could comprise a combination filter having perforated inner and outer cylinders which are axially rotatable to increase or to decrease the overall permeability of the combination filter. Other configurations and combinations of filter compounds and materials can be made without departing from the scope of the invention.

Figure 5:
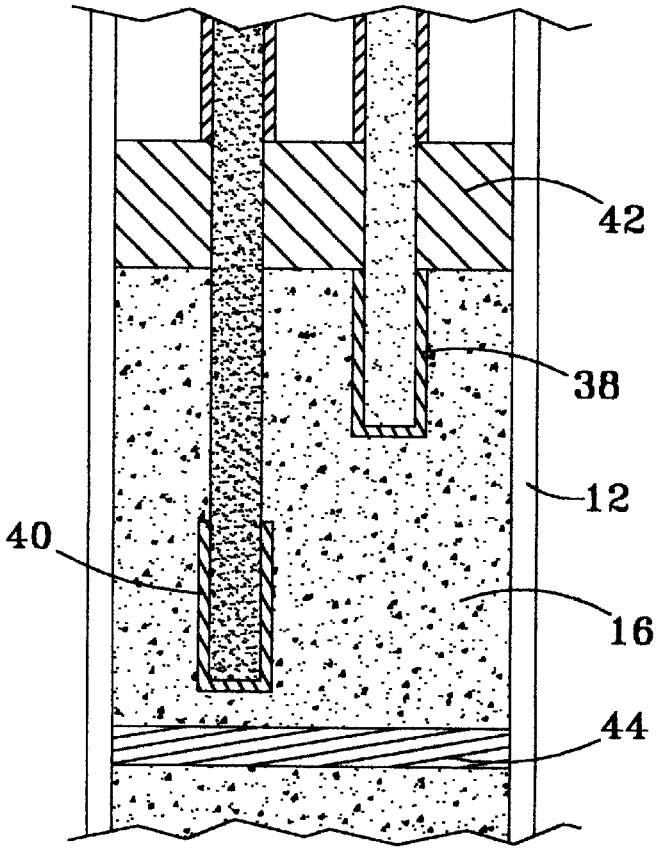
FIG. 5 illustrates an embodiment of the invention having two filters proximate to a packer.

FIG. 5 illustrates another embodiment of the invention wherein two permeable filters 38 and 40 are positioned proximate to a body such as packer 42. Filter 38 can selectively permit the migration of natural gas, while filter 40 selectively permits the migration of oil. It will be appreciated that different combinations of multiple filters can be used to accomplish different results. For example, filter 40 can be located deeper in wellbore 10 than filter 38 to achieve a greater pressure differential, thereby permitting the passage of oil or other less permeable compound through filters 40. Alternatively, the configuration or composition of filters 38 and 40 can be selected to achieve different permeabilities for different compounds at the same relative elevation within wellbore 10. Conventional well screen 44 can be positioned within wellbore 10 to capture sand and other contaminants within well fluid 16.

The method of the invention is practiced by positioning a body such as packer 14 downhole in wellbore 10. Packer 14 is set to close wellbore 10 and to isolate well fluids 16 below packer 14 from the atmospheric pressure at the surface of wellbore 10. Permeable filter 20 is positioned proximate to aperture 18 in packer 14, either before packer 14 is run into wellbore 10 or after packer 14 is set. Finally, hydrocarbons are selectively permitted to migrate through filter 20 and through aperture 18 in packer 14, while restricting selected well fluids 16 from migrating through filter 20.

In different embodiments of the inventive method, packer 14 and filter 20 can be positioned at a selected position below the interface elevation of well fluids 16, and such position can be measured with a conventional pressure sensor (not shown) or can be calculated from the well fluid 16 properties. The differential pressure across filter 20 can be selectively controlled with various mechanisms, and more than one filter can be simultaneously operated within wellbore 10. In another embodiment of the invention, the permeability of the filter can be adjusted with a mechanical device or valve.

Although the invention has been described in terms of certain preferred embodiments, it will be apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

I claim:

1. An apparatus for separating hydrocarbons from other well fluids downhole in a wellbore extending downwardly from a well surface, comprising:

a body for closing the wellbore to isolate the well fluids below said body from atmospheric pressure at the well surface;

a permeable filter for selectively permitting hydrocarbons below said body to pass through said filter and for selectively restricting other well fluids below said body from passing through said filter wherein the permeability of said filter is adjustable depending on the differential pressure across said filter; and an aperture through said body for permitting hydrocarbons passing through said filter to move above said body.

2. An apparatus as recited in claim 1, wherein said filter comprises a close tolerance wire screed filter.

3. An apparatus as recited in claim 1, wherein said filter comprises a sintered material.

4. An apparatus as recited in claim 1, wherein said filter comprises a ceramic material.

5. An apparatus as recited in claim 1, wherein said filter selectively restricts water in the well fluid from passing through said filter.

6. A method for separating hydrocarbons from other well fluids downhole in a wellbore where the well fluids reach an interface elevation with the wellbore, comprising:

positioning a body downhole in the wellbore, at a selected operating elevation below said interface elevation, to close the wellbore and to isolate the well fluids below said body from atmospheric pressure at the well surface, wherein said body has an aperture for selectively permitting passage of hydrocarbons therethrough;

positioning a permeable filter proximate to said aperture through said body; and selectively permitting hydrocarbons to pass through said filter and above said body through said aperture while restricting selected well fluids from passing through said filter.

7. A method as recited claim 6, further comprising the step of controlling the differential pressure across said filter to selectively control the hydrocarbons passing through said filter and to selectively restrict the well fluids from passing through said filter.

8. A method as recited in claim 6, further comprising the step of positioning a second filter downhole in the wellbore to selectively permit the passage of one hydrocarbon through said second filter while restricting the passage of other hydrocarbons through said second filter.

9. A method as recited in claim 6, wherein the permeability of said filter is adjustable, further comprising the step of adjusting the permeability of said filter after said filter is positioned downhole in the wellbore.

* * * * *